US007861362B2

(12) United States Patent
Varner

(10) Patent No.: US 7,861,362 B2
(45) **Date of Patent: *Jan. 4, 2011**

(54) COMPOUND WATER-WIPER APPARATUS

(76) Inventor: Donald Varner, 13101 Somerset Dr., Grass Valley, CA (US) 94955

( * ) Notice: Subject to any disclaimer, the term of this patent is extended or adjusted under 35 U.S.C. 154(b) by 0 days.

This patent is subject to a terminal disclaimer.

(21) Appl. No.: 12/629,336

(22) Filed: Dec. 2, 2009

(65) Prior Publication Data

US 2010/0071146 A1 Mar. 25, 2010

Related U.S. Application Data

(63) Continuation of application No. 11/452,799, filed on Jun. 13, 2006, now Pat. No. 7,627,924.

(51) Int. Cl.
*A47L 1/06* (2006.01)
*A47L 13/11* (2006.01)

(52) U.S. Cl. ..... 15/245; 15/143.1; D32/41

(58) Field of Classification Search ..... 15/143.1, 15/245, 245.1, 250.04, 250.36, 250.41, 250.42, 15/250.48; D32/41
See application file for complete search history.

(56) References Cited

U.S. PATENT DOCUMENTS 229,430 A * 6/1880 Linscott ..... 15/245
592,076 A * 10/1897 Brown ..... 15/245
D28,990 S * 7/1898 Cumming ..... D32/41
2,187,876 A * 1/1940 Ericson ..... 15/250.19
2,707,292 A * 5/1955 Lustbader ..... 401/139
3,224,027 A * 12/1965 Oishei et al. ..... 15/250.41
3,224,997 A * 12/1965 Hunter ..... 523/171
3,428,997 A * 2/1969 Rickett ..... 15/250.48
4,700,425 A * 10/1987 Rusnak ..... 15/250.41
4,723,336 A * 2/1988 Nakayama ..... 15/250.41
5,101,530 A * 4/1992 Hansen et al. ..... 15/245
5,392,488 A * 2/1995 Li ..... 15/250.41
D488,898 S * 4/2004 Ben-Moshe ..... D32/41

* cited by examiner

*Primary Examiner*—Mark Spisich
(74) *Attorney, Agent, or Firm*—Donald R. Boys; Central Coast Patent Agency, Inc.

(57) ABSTRACT

A water-wiper apparatus has a handle having a height, width, and length with a substantially oval shape in cross-section orthogonal to the length, a major axis of the oval shape in the direction of the height, the handle formed of a rigid or semi-rigid material, a first engagement interface along the length of the handle in a region bisected by the major axis, the engagement interface comprising a channel having a shape and a first width and an opening of a second width less than the first width to the outside of the handle, and a wiper blade of the length of the handle, formed of a flexible material and having a second engagement interface shaped to engage the first engagement interface, engaging the wiper blade with the handle, the wiper blade having a curved side in cross section from the handle to a tip end of a wiper leg away from the handle, the curve of the side having a radius of from one-half inch to one-and-one-half inches.

11 Claims, 3 Drawing Sheets

COMPOUND WATER-WIPER APPARATUS

CROSS-REFERENCE TO RELATED APPLICATIONS

The present application is a continuation application of application Ser. No. 11/452,799, filed on Jun. 13, 2006, now issued as U.S. Pat. No. 7,627,924. The above referenced application is included in its entirety in this specification at least by reference.

BACKGROUND OF THE INVENTION

1. Field of the Invention

The present invention is in the area of apparatus and methods for removing excess water from surfaces such as the exterior of an automobile or a truck.

2. Discussion of the State of the Art

One of the largest and most lucrative product markets in the United States involves cosmetic accessories for automobiles and light trucks. There are literally thousands of products available that are dedicated to enhancing the cosmetic appearance of a consumer's pride and joy, namely, his automobile. From products that add luster to an expensive paint job, to products that add sparkle to chrome, all one has to do is visit a local parts store to see discover a broad range of such innovative products.

One category of products possibly containing a poor variety from which to choose is car-wash products. Car-wash accessories known in the art include special towels for removing water and drying automobile finishes after a car-wash, or chamois cloths for absorption of excess water and the like. Other products in this category include automated hot-air blowers for quick drying the automobile finish, or various hand-held cloth or synthetic pads for rubbing excess water off of an automobiles finish. Recently there has been an introduction of products called water-wiper blades for removing standing water from surfaces, such as the surfaces of automobiles and trucks, especially following washing, to replace the operations of drying with towels or chamois materials.

There are some problems and unmet needs with the existing water-wiper blades at the time of the present invention. One is the complexity and cost of the handles and the wiper blades that are used in these devices. Another is in the manner in which blades are attached to handles, and the inconvenience of attaching a new blade to a handle. Yet another problem is in the fit of a handle to the human hand. And still another is the functionality of a wiper blade in directing captured water to the sides of the blade for expulsion.

SUMMARY OF THE INVENTION

In an embodiment of the present invention a water-wiper apparatus is provided, comprising a handle having a height, width, and length with a substantially oval shape in cross-section orthogonal to the length, a major axis of the oval shape in the direction of the height, the handle formed of a rigid or semi-rigid material, a first engagement interface along the length of the handle in a region bisected by the major axis, the engagement interface comprising a channel having a shape and a first width and an opening of a second width less than the first width to the outside of the handle, and a wiper blade of the length of the handle, formed of a flexible material and having a second engagement interface shaped to engage the first engagement interface, engaging the wiper blade with the handle, the wiper blade having a curved side in cross section from the handle to a tip end of a wiper leg away from the handle, the curve of the side having a radius of from one-half inch to one-and-one-half inches.

In one embodiment the handle is a hollow shell with open ends and a wall thickness. Also in one embodiment the handle is filled with a flexible material. In some embodiments the handle is formed of two-pieces joined along the vertical major axis of the oval shape, held together by clips or fasteners.

In one embodiment the wiper leg has a declining width and ends in a rounded wiping tip having a diameter no more then the width of the leg at the tip, and no more than one-eighth of an inch. In another embodiment the wiper leg has a declining width, and ends in a rounded tip having a major diameter greater than the width of the wiping leg where the leg meets the rounded tip. In yet another embodiment the wiper leg has a declining width, and ends in a tip turning at substantially a right angle to the direction of the wiper leg, and ending in a rectangular flat surface. In still another embodiment the wiper leg has a declining width, and ends in a tip of triangular shape turning at substantially a right angle to the direction of the wiper leg, and ending in a thin wiping line. In some other embodiment the wiper leg has a declining width, and comprises two or more extensions of triangular shape turning at substantially a right angle to the direction of the wiper leg, the triangular extensions directed toward the convex curvature of the wiper blade.

In another aspect the wiper blade has two curved sides in cross section, each side curved inward from the handle to a tip end of a separate wiper leg away from the handle, the curves of the sides being the same having a radius of from one-half inch to one-and-one-half inches, and the wiper legs separated by an inverted notch at the bottom of the wiper blade. IN some embodiments the wiper blade has hardness of from about 60 to 90 Durometer on the A scale.

BRIEF DESCRIPTION OF THE DRAWING FIGURES

FIG. 1*a* is an end elevation view of a water-wiper apparatus according to an embodiment of the present invention.

FIG. 1*b* is a side elevation view of the apparatus of FIG. 1*a*.

FIG. 2*a* illustrates a wiper leg having a rounded end.

FIG. 2*b* illustrates a wiper leg having a right-angle extension with a flat, rectangular end.

FIG. 2*c* illustrates a wiper leg having triangular extensions.

FIG. 2*d* illustrates a wiper leg having a ball-shaped wiping end.

FIG. 2*e* illustrates a wiper leg having a square-shaped wiping end.

DETAILED DESCRIPTION OF THE INVENTION

Figures 1A, 1B:
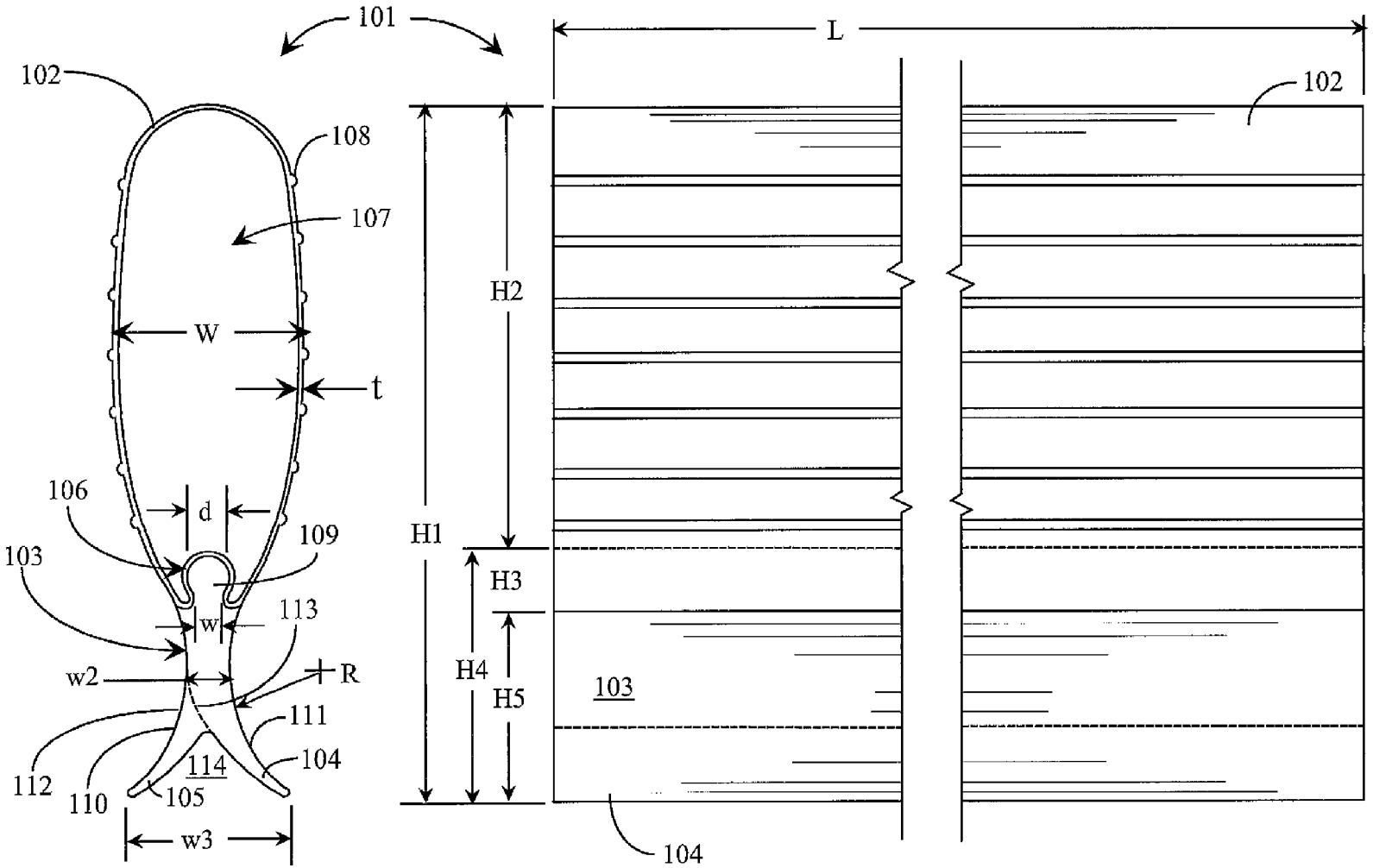

FIG. 1*a* is a side elevation view of a water-wiper apparatus 101 according to an embodiment of the present invention. Apparatus 101 comprises a handle 102 and a wiper blade 103, joined in this embodiment through a shaped engagement interface 106.

Handle 102 in one embodiment is a one-piece extruded shell with a wall thickness "t", in which the interior volume 107 is empty. Wall thickness "t" may vary considerably, in part due to the kind of material used for the shell walls. In one embodiment the material is polycarbonate, and the handle is extruded, but other materials may be used, such as polypropylene. In any case the shell is preferably self-standing and relatively rigid. In some embodiments the hollow interior may be filled with another material, such as a foam material. In yet other embodiments there may be ends pieces attached to the handle at one or both ends, and the interior may be hollow or filled.

Another feature of handle 102 in the embodiment shown is a series of ridges 108 which are implemented to provide a sure grip for a user's hand. In the embodiment shown there are seven such ridges spaced apart on each side of the handle, but there may be more or fewer in other embodiments. These ridges may be extruded with the handle or otherwise molded into the handle parts, or may in some embodiments be added in another way. It is not required that the ridges be linear as shown, but linear ridges are a convenience.

In some embodiments the handle may be molded in two separate pieces, and the halves may be fastened together with such as conventional fasteners, like bolts or screws. Width "W" of the handle may vary as well. In the embodiment shown W is about one inch, but might vary in other embodiments from about 0.75 inch to about 1.5 inches. The overall height of the handle is about 2.5 inches in the embodiment shown, and might in other embodiments vary between 2.0 inches and about 4.0 inches. This overall handle height is H2+H3 in FIG. 1. H3 is about 0.313 inches, so H2 becomes about 2.19 inches, but again these dimensions may vary somewhat in other embodiments.

Figure 3:
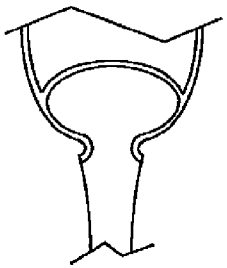
FIG. 3 is an illustration of an ovoid interface between a blade and handle in an embodiment of the invention.
Figure 4:
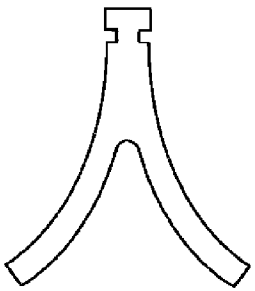
FIG. 4 is an illustration of another wiper blade and wiper leg arrangement in an embodiment of the invention.

Engagement interface 106 is in this embodiment a rounded channel molded into the handle or handle parts, such that the channel has a narrow portion "w" of less width than the full diameter or width "d" of the rounded channel. The purpose of this channel is to engage a portion of wiper blade 103 to hold the handle and the blade together in use. The channel runs the full length of the handle, represented as length "L" in FIG. 1*b*. In some embodiments the length "L" is about 12 inches, but this length may be somewhat less, or considerable longer in some other embodiments. Further, the channel is not necessarily limited to a round aspect, but may in some embodiments be more oval, with the major diameter at a right angle to the height, and in other embodiments may assume yet other shapes, such as substantially square or rectangular. FIG. 3 illustrates an embodiment wherein the channel is more oval then in FIG. 1*a*, and FIG. 4 illustrates a channel in an embodiment wherein the channel is rectangular.

Wiper blade 103 is a flexible molded or extruded blade made in one embodiment of low-grade silicone or vinyl, or other suitable material of a hardness of between about 45 to 75 Durometer on the A scale. The blade is injection molded or extruded, or otherwise formed, to have a ridge 109 of the diameter or width "d" of the channel of engagement interface 106, and shaped to engage the channel fully. That is, if the channel is round the ridge is also round; if the channel is rectangular, the ridge is also rectangular, and if the channel is ovoid, the ridge is of an oval shape as well.

The blade otherwise shaped in this embodiment to have curved sides 111 and 112, which, when the blade is assembled to the handle, conform to the line of the handle as shown, creating a continuous curvature over the handle and the blade. The curvature of the sides 111 and 112 of blade 103 is in some embodiments, over a portion of the height, a circular curve having a radius "R" as shown. Radius "R" in the embodiment shown is about 1", but may vary in other embodiments from about 0.5 inch to about 1.5 inches. In the embodiment shown the width w2 of the wiper blade at its narrowest portion is about 0.313 inches. This width and the shape of the blade may be adjusted in some embodiments to provide a different wiping effect.

Blade 103 is formed such that the curvature of sides 110 and 111, together with a notch 114, forms, in a preferred embodiment, two wiping legs 104 and 105, which end in relatively narrow wiping tips. In some embodiments the blade is formed on just one side along dotted line 113, so that only one wiper leg 104 is formed with a single wiping tip.

In use to wipe water from the surfaces of an automobile, such as after washing and rinsing the automobile, a user grasps handle 102 with one or both hands, presents the wiping edge of one of the legs 104 or 105 to the surface to be wiped, typically with the height of the apparatus at an acute angle to the surface (less than ninety degrees), and draws the blade for a substantial stroke along the surface. In some cases the drawing action may be presented at an angle other than ninety degrees to the line of the blade, which will cause the displaced water to be urged along the blade to one side to the trailing edge. The curvature "R" of the blade also aids in channeling the displaced water to the side.

Figure 2A:
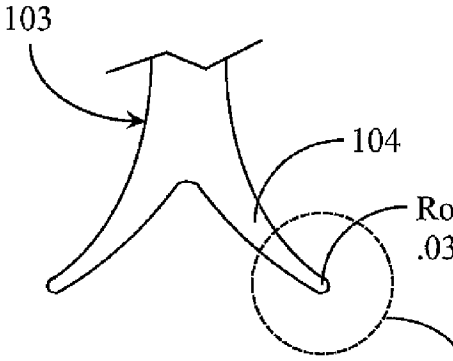
Figure 2B:
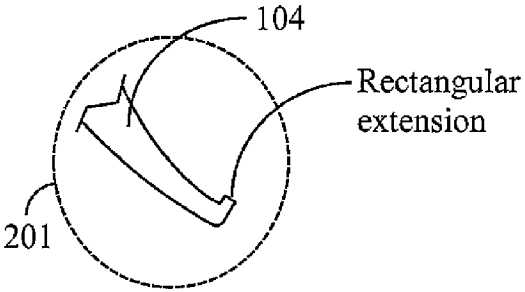

In some embodiments the wiper blade may be used with legs 104 and 105 as shown in FIG. 1*a*, just somewhat rounded on the ends. Several other features, however, have been implemented and are useful for wiping water from surfaces. FIG. 2*a* for example, illustrates in circle 201 the end of leg 104 as shown in FIG. 1*a*, where the end is rounded with a small radius, in this case about 0.03 inches. FIG. 2*b* illustrates an end of a wiper blade in an alternative embodiment, shown within circle 201, having rectangular-shaped extension protruding at about a right angle from the curvature line of the wiper leg. In this embodiment a flat end of the extension contacts the surface to be wiped, and the extension, which forms a sharp angle where it joins with the leg, helps to guide collected water to one side.

Figure 2C:
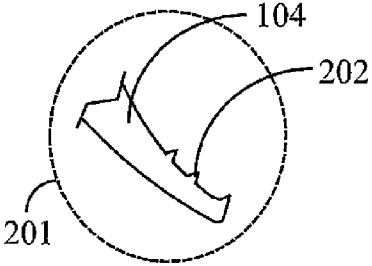

FIG. 2*c* illustrates yet another wiper tip treatment, having one or more triangular-shaped extensions along the wiper leg at or parallel to the tip of the leg. In some embodiments the triangular extension is only at the tip, in some at the tip and one other place higher on the lag, and in some cases only at positions higher on the leg. The lowest one of the extensions typically contacts the surface to be wiped, and a higher one of the extensions helps to channel water to the sides as a surface is wiped.

Figure 2E:
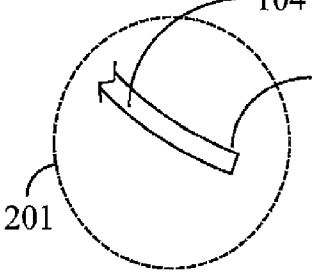
Figure 2D:
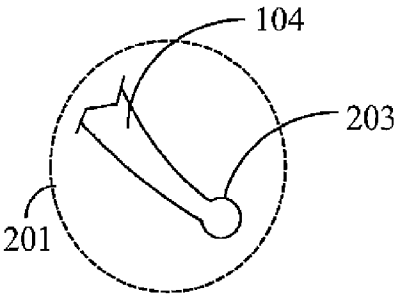

FIG. 2*d* illustrates yet another treatment of wiper legs in an embodiment of the invention, wherein the tip of the wiper leg is implemented as a round protuberance of a diameter substantially greater than the width of the leg at the end of the leg. FIG. 2*e* illustrates yet another treatment wherein the end of the leg is an oval-shaped protuberance. In all of these cases the extension or protuberance preferably extends for the full length of the wiper blade.

FIG. 2*e* illustrates still another treatment of wiper legs in an embodiment of the invention, wherein the leg itself is not tapered, but maintains a relatively constant wall thickness, and the end, or tip of the lag is square, as shown. Additionally, in some embodiments with tips as shown in FIGS. 2*a* through 2*d*, the wall thickness of the leg may be relatively constant, rather than tapered.

Figure 5:
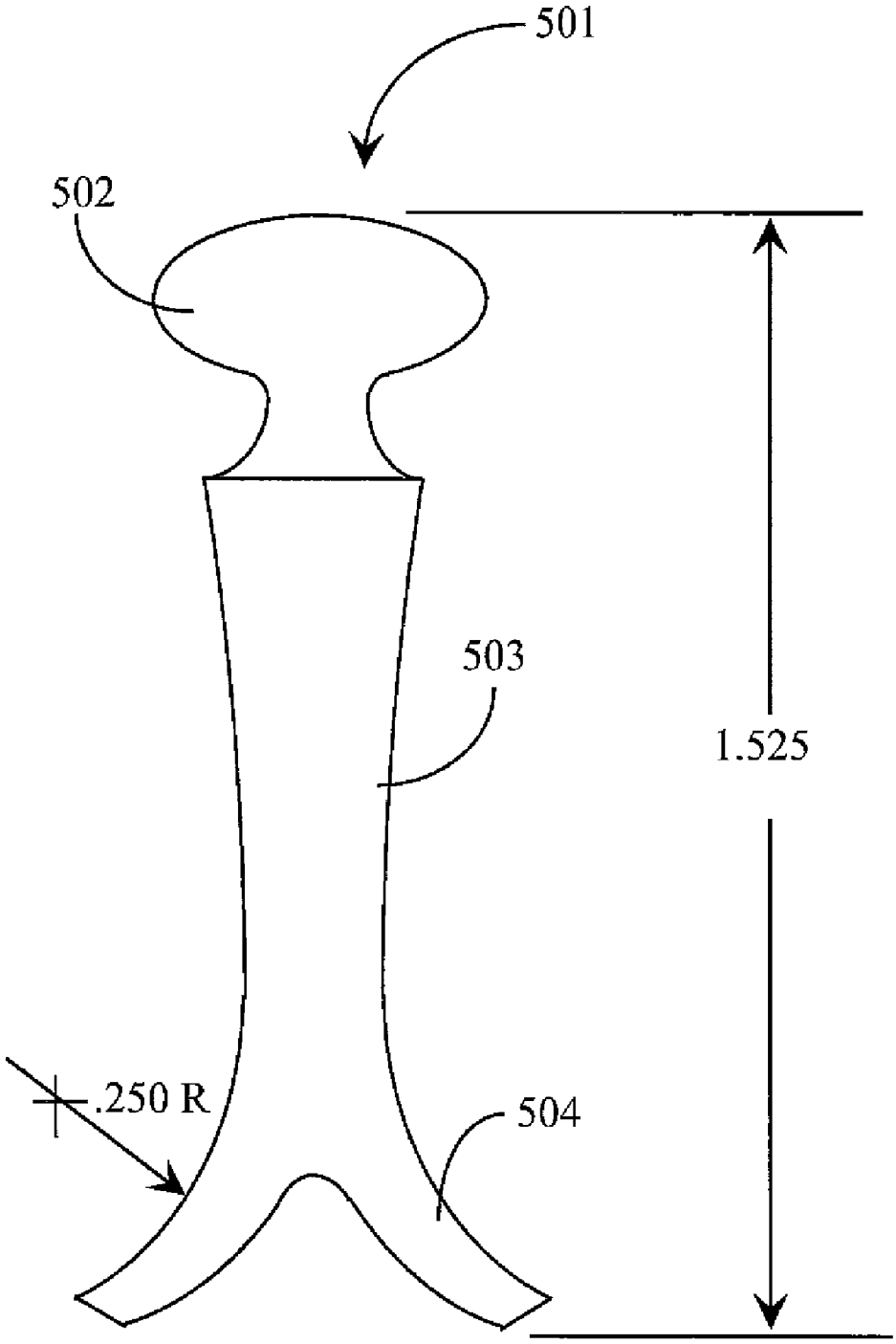
FIG. 5 is an elevation view of a wiper blade in yet another embodiment of the present invention.

FIG. 5 illustrates a wiper blade 501 in another embodiment of the invention, comprising an ovoid ridge portion 502 for engaging a channel in a handle as described above, a blade portion 503, and wiper legs 504. In this embodiment the overall height of blade 501 is 1.525, but this dimension may vary between about 1 to 2 inches in other embodiments. At the interface of blade 503 and wiper leg 504 the radius in this embodiment is about 0.25 inches, as shown. The ends of legs 504 are flat, and not square, but angled.

It will be apparent to the skilled artisan that a number of alterations might be made to the embodiments of the present invention described thus far without departing from the spirit and scope of the invention. For example, there are a variety of materials that might be used in different embodiments. Natural or synthetic rubber might be used, for example, for the wiper blade and many rigid and semi-rigid materials, or even metals might be used for the handle. There are many ways such a blade and a handle might be joined other than the specific ways described above. There are similarly a variety of changes in dimensions that might be made within the spirit and scope of the invention. For these and other reasons the invention is only limited by the scope of the claims that follow.

What is claimed is:

1. A hand-held water-wiper apparatus, comprising:

a handle symmetrical in cross-section about a vertical axis, formed of a rigid or semi-rigid material, having a height from two inches to four inches, a width at its widest point of from three-quarter inch to one and one-half inch, and a length, the handle rounded along an upper edge, and tapering to an engagement groove along a lower edge; and a wiper blade also symmetrical in cross-section about the vertical axis of the handle, having substantially the length of the handle and a height of from one to two inches, formed of a flexible, deformable material, having an engagement ridge along the uppermost edge, the ridge engaging the groove of the handle, two wiper legs along a lowermost edge;

wherein the wiper legs curve downward and outward from the vertical axis to opposite sides, and are separated by an inverted notch.

2. The apparatus of claim 1 wherein the handle is a hollow shell with open ends and a wall thickness.

3. The apparatus of claim 1 wherein the handle is filled with a flexible material.

4. The apparatus of claim 1 wherein the handle is formed of two-pieces joined along the vertical major axis of the oval shape, held together by clips or fasteners.

5. The apparatus of claim 1 wherein each wiper leg has a declining width and ends in a rounded wiping tip having a diameter no more than the width of the leg at the tip, and no more than one-eighth of an inch.

6. The apparatus of claim 1 wherein each wiper leg has a declining width, and ends in a rounded tip having a major diameter greater than the width of the wiping leg where the leg meets the rounded tip.

7. The apparatus of claim 1 wherein each wiper leg has a declining width, and ends in a tip turning at substantially a right angle to the direction of the wiper leg, and ending in a rectangular flat surface.

8. The apparatus of claim 1 wherein each wiper leg has a declining width, and ends in a tip of triangular shape turning at substantially a right angle to the direction of the wiper leg, and ending in a thin wiping line.

9. The apparatus of claim 1 wherein each wiper leg has a declining width, and comprises two or more extensions of triangular shape turning at substantially a right angle to the direction of the wiper leg, the triangular extensions directed toward the convex curvature of the wiper blade.

10. The apparatus of claim 1 wherein the wiper blade has two curved sides in cross section, each side curved inward from the handle to a tip end of a separate wiper leg away from the handle, the curves of the sides being the same having a radius of from one-half inch to one-and-one-half inches, and the wiper legs separated by the inverted notch at the bottom of the wiper blade.

11. The apparatus of claim 1 wherein the wiper blade has hardness of from about 45 to 75 Durometer on the A scale.

* * * * *